US007021036B2

(12) United States Patent
Hiramoto et al.

(10) Patent No.: US 7,021,036 B2
(45) Date of Patent: Apr. 4, 2006

(54) BAG-MAKING AND PACKAGING MACHINE

(75) Inventors: Shinichi Hiramoto, Iwakuni (JP); Shoji Tsutsui, Iwakuni (JP); Masakazu Setozaki, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 69 days.

(21) Appl. No.: 10/781,190

(22) Filed: Feb. 17, 2004

(65) Prior Publication Data

US 2004/0206056 A1 Oct. 21, 2004

(30) Foreign Application Priority Data

Feb. 17, 2003 (JP) ..... 2003-037729

(51) Int. Cl.
*B65B 43/04* (2006.01)

(52) U.S. Cl. ..... 53/562; 53/253; 53/284.7; 493/186; 493/189

(58) Field of Classification Search ..... 53/562, 53/453, 455, 459, 468, 469, 479, 555, 558, 53/570, 573, 253, 267, 248.7, 285, 384.1, 53/386.1; 493/186, 189
See application file for complete search history.

(56) References Cited

U.S. PATENT DOCUMENTS

| | | | | |
|---|---|---|---|---|
| 3,534,520 | A | 10/1970 | Moran | |
| 3,545,166 | A | 12/1970 | Johnson et al. | |
| 3,855,907 | A | 12/1974 | Johnson et al. | |
| 4,473,989 | A * | 10/1984 | Tsutsumi et al. | 53/459 |
| 4,611,455 | A * | 9/1986 | Aiuola et al. | 53/374.9 |
| 4,726,170 | A * | 2/1988 | Sawa et al. | 53/570 |
| 5,335,478 | A * | 8/1994 | Aronsen | 53/412 |
| 5,603,202 | A * | 2/1997 | Hanagata | 53/550 |
| 5,862,653 | A * | 1/1999 | Solano | 53/562 |
| 5,941,052 | A * | 8/1999 | Evangelisti | 53/433 |
| 6,047,528 | A * | 4/2000 | Scholin et al. | 53/455 |
| 6,138,436 | A * | 10/2000 | Malin et al. | 53/133.4 |
| 6,272,815 | B1 * | 8/2001 | Todd et al. | 53/562 |
| 6,574,942 | B1 * | 6/2003 | Heimann et al. | 53/413 |
| 2001/0015056 | A1 * | 8/2001 | Hiramoto et al. | 53/479 |
| 2001/0048759 | A1 * | 12/2001 | Hiramoto et al. | 382/141 |

FOREIGN PATENT DOCUMENTS

| | | | |
|---|---|---|---|
| EP | 2002-36392 | | 2/2002 |
| JP | 56-113522 | | 9/1981 |
| JP | 411227803 | A * | 8/1999 |
| WO | WO 99/44892 | | 9/1999 |

* cited by examiner

*Primary Examiner*—Stephen F. Gerrity
*Assistant Examiner*—Thanh Truong
(74) *Attorney, Agent, or Firm*—Koda & Androlia

(57) ABSTRACT

A bag-making and packaging machine including a bag-making apparatus 1, a bag-filling (packaging) apparatus 2, and a bag transfer apparatus. The bag-making apparatus 1 of a bag-making and packaging machine, while releasing a film F from a film roll disposed in the horizontal direction and feeding the film lengthwise, folds and overlaps the film in two in a horizontal attitude, performs sealing in locations corresponding to the bag bottom portions and side portions of the film in the horizontal attitude, and separates bags by cutting. The line corresponding to the bag bottom ends of the folded and overlapped film F (this position indicated by S) is set in the same position regardless of the bag length, and the respective apparatuses such as the forming apparatus 5, sealing apparatuses 8, 9 and 11, and cutting apparatus 14, etc. are disposed with reference to this position.

20 Claims, 9 Drawing Sheets

BAG-MAKING AND PACKAGING MACHINE

BACKGROUND OF THE INVENTION

1. Field of the Invention

The present invention relates to a bag-making and packaging machine that includes both a bag-making apparatus and a bag-filling packaging apparatus.

2. Prior Art

Bag-making and packaging machine are described in, for example, the specifications of Japanese Patent Application Laid-Open (Kokai) Nos. 56-113522 and 2002-36392 and U.S. Pat. No. 5,862,653, and such a bag-making and packaging apparatus includes a bag-making apparatus, a bag-filling packaging apparatus and a bag transfer apparatus.

The bag-making apparatus manufactures bags by performing a bag-making operation such as folding and overlapping by a forming apparatus, a sealing operation of the bag bottom portions and corresponding locations on the side portions of the bags by a sealing apparatus, and a separation operation of the bags by cutting by a cutting apparatus, etc., while unwrapping a film from a film roll whose axial center is disposed in a horizontal attitude and feeding this film in the direction of length. The bag-filling packaging apparatus grips both side edges of the bags by grippers, thus suspending the bags, intermittently moving these suspended bags along an annular path, and performing packaging operations such as filling of the bags with contents and sealing of the mouths of the bags, etc. at respective stopping positions. The bag transfer apparatus receives bags at a receiving position at the final end of the bag-making apparatus, conveys these bags to a transfer position, and transfers these bags to the grippers of the bag-filling packaging apparatus.

In the conventional bag-making and packaging machine, the bag-making apparatus folds the film in two and overlaps the film in the vertical direction (so that the bag mouth side is on top) in the central portion while unwrapping the film from a film roll whose axial center is disposed in a horizontal attitude and feeding this film in the direction of length, and then the bag-making apparatus performs bag-making operations such as sealing and cutting (cutting into respective bags), etc. on this film.

The bags that are cut from the continuous film are received by the bag transfer apparatus and are transferred to the grippers of the bag-filling packaging apparatus.

In the conventional bag-making and packaging machine, it is sufficient if bags that are manufactured in a vertical attitude are transferred in this attitude to the gripper of the bag-filling packaging apparatus. Accordingly, the advantage is that it has a simplified mechanism.

On the other hand, it has some problems. (1) Since the film is fed with the side that forms the inside surfaces of the bag facing upward until the film is folded and overlapped, and since the bag mouth side faces upward following folding and overlapping, foreign matter such as dirt, etc. tends to enter the interiors of the bags. (2) The bags that are manufactured by the bag-making apparatus include self-standing bags in which the bottom side of the bag is thick. As a result, the cutting of the bags is always performed from the lower side (bag bottom side); however, in cases where defective sealing or defective cutting of the film occurs, defective bags that are discharged downward or that hang downward tend to become entangled with the cutting blades and swinging shafts of the cutting blades, thus leading to further defective cutting and stopping of the bag-making and packaging machine.

In order to improve productivity, in the bag-making and packaging machines disclosed in the above-described Japanese Patent Application Laid-Open (Kokai) No. 2002-36392 and U.S. Pat. No. 5,862,653, two bags are manufactured at one time, these bags are simultaneously transferred to two sets of grippers in the bag-filling packaging apparatus, and the filling operation performed in the bag-filling packaging apparatus is also performed simultaneously for two bags (such machines are called W type machines after the configuration in which two bags are lined up on the left and right). However, no W type bag-making and packaging machine has been disclosed that can easily handle changes (alterations) in the bag size (bag length and/or bag width).

SUMMARY OF THE INVENTION

Accordingly, it is an object of the present invention to provide a bag-making and packaging machine (including a W type machine) that includes an improved bag-making apparatus which is free of the above-described problems (1) and (2).

It is another object of the present invention to provide a bag-making and packaging machine that can easily handle (or meet) the changes in the size of the bags (bag length and/or bag width).

The above objects are accomplished by unique structures of the present invention for a bag-making and packaging machine that includes:

- a bag-making apparatus which manufactures bags by performing a bag-making operation while unwrapping a film from a film roll whose axial center is disposed in a horizontal attitude and feeding the film in a direction of length thereof, the bag-making operation including:
  - a folding and overlapping operation of the film done by a forming apparatus,
  - a sealing operation of film locations that correspond to bag bottom portions and side portions done by a sealing apparatus, and
  - a separating operation of bags by cutting done by a cutting apparatus;
- a bag-filling packaging apparatus which grips both side edges of the bags by means of grippers thus suspending the bags, intermittently moves the suspended bags along an annular path, and performs packaging operations including filling of the bags with contents and sealing of mouths of the bags, at respective stopping positions; and
- a bag transfer apparatus which receives the bags at a receiving position at the final end of the bag-making apparatus, conveys the bags to a transfer position, and transfers the bags to the grippers of the bag-filling packaging apparatus; and in the present invention

- the above-described bag-making apparatus is a horizontal type bag-making apparatus in which:
  - the film is folded in two and overlapped in a horizontal attitude by the forming apparatus, and bag-making operations following the folding and overlapping are performed on the film that is fed in a horizontal attitude,
  - positions corresponding to lower ends of folded and overlapped film bags are set in same positions regardless of a bag length, and
  - the respective apparatuses of the bag-making apparatus that perform the bag-making operation are disposed with reference to the positions; and the above-described bag transfer apparatus receives bags in a horizontal attitude, stands the bags upright, and transfers the bags to the grippers of the bag-filling packaging apparatus.

In the above bag-making and packaging apparatus of the present invention, the bag transfer apparatus includes, for instance, a suction plate, which is disposed in a vertical plane perpendicular to a feeding direction of the film so that the suction plate is free to swing, and a suction plate swing mechanism, which causes the suction plate to swing in a reciprocating motion between a lower downward-facing position and an upper sideward-facing position; and in this structure, the suction plate suction-chucks bag surfaces of the bags in a horizontal attitude when the suction plate is in the downward-facing position, and stands the bags upright when the suction plate is in the sideward-facing position, and the position of the axial line of the swing motion of the suction plate is freely adjusted within the horizontal plane in the direction perpendicular to the feeding direction of the film.

The reason that the position of the above-described axial line is made freely adjustable is to comply with different lengths of the bags.

The bags can be conveyed from the receiving position to the transfer position using only the suction plate; and as described in, for example, Japanese Patent Application Laid-Open (Kokai) No. 3-176338, it is also possible to install both a suction plate that lifts the bags from the receiving position and clamping elements used for horizontal feeding. In cases where the bags are conveyed from the receiving position to the transfer position using only a suction plate, the suction plate is devised, for instance, so that the suction plate can advance and retract in the forward-rearward direction (the front surface of the suction plate is "forward" in this case), and this suction plate is caused to advance and retract at a specified timing. More specifically, when the suction plate is in the downward-facing position, the suction plate is lowered by a specified distance toward the receiving position (in this case, the bag surface is suction-chucked in the receiving position) and is then raised; and when the suction plate is in the sideward-facing position, the suction plate is caused to advance by a specified distance toward the transfer position (in this case, the bag is transferred to the grippers) and is then retracted.

The above-described bag transfer apparatus includes, more specifically, a swing supporting shaft that is disposed parallel to the feeding direction of the film, a slide shaft holder that is fastened to the swing supporting shaft, a slide shaft that is supported on the slide shaft holder so as to be free to slide in a direction of length thereof and is provided perpendicular to the swing supporting shaft, a suction plate that is attached to the front end of the slide shaft, a suction plate swing mechanism that causes the swing supporting shaft to make a reciprocating rotational motion and thus causes the suction plate to make a reciprocating swing motion together with the slide shaft between a lower downward-facing position and an upper sideward-facing position, and a suction plate advancing and retracting mechanism that causes the slide shaft to slide in a direction of length thereof and thus causes the suction plate to advance or retract; and in this structure, the suction plate advancing and retracting mechanism lowers the suction plate by a specified distance toward the receiving position and then raises the suction plate when the suction plate is in the downward-facing position, and further causes the suction plate to advance by a specified distance toward the transfer position and then retracts the suction plate when the suction plate is in the sideward-facing position, and the swing supporting shaft is freely adjustable positionally in the horizontal plane in the direction perpendicular to the feeding direction of the film.

The present invention is applicable to a W type bag-making and packaging machine. In such a W type bag-making and packaging machine:

the bag-making apparatus is a W type bag-making apparatus which manufactures two bags at a time by causing the amount of the film that is intermittently fed from the sealing apparatus on to be twice the bag width and performing respective bag-making operations at the same time on the film that is twice the bag width;

the bag-filling packaging apparatus is a W type bag-filling packaging apparatus in which bags are simultaneously supplied to two adjacent sets of grippers, and packaging operations are simultaneously performed on the two bags gripped by the two sets of grippers; and the bag transfer apparatus is a W type bag transfer apparatus which receives two bags at the receiving position, conveys the bags to the transfer position, and transfers the bags to the two sets of grippers of the bag-filling packaging apparatus.

In this W type bag-making and packaging machine, the fact that the amount of film that is intermittently fed at one time is set at twice the bag width from the sealing apparatus on in the bag-making apparatus means that there is no surplus portion as described in the above-described Japanese Patent Application Laid-Open (Kokai) No. 2002-36392 (i.e. there is no gap between the two bags that are simultaneously manufactured).

In the above W type bag-making and packaging machine, the bag transfer apparatus includes, for instance two sets of suction plates, which are disposed so that the two sets of suction plates are free to swing in a vertical plane that is perpendicular to the feeding direction of the film and which are disposed along the film feeding direction, and a suction plate swing mechanism, which causes the two sets of suction plates to simultaneously make a reciprocating swing motion between a lower downward-facing position and an upper sideward-facing position; and in this structure:

the bag surfaces of bags in a horizontal attitude are suction-chucked when the two sets of suction plates are respectively in the downward-facing position, the bags are caused to stand upright when the two sets of suction plates reach the sideward-facing position, the axial lines of the swing motion of the two sets of suction plates are in common, and the positions of the axial lines is freely adjustable in the horizontal plane in the direction perpendicular to the feeding direction of the film.

As described previously, bags can be conveyed from the receiving position to the transfer position using only the two sets of suction plates, and it is also possible to install both suction plates that lift the bags from the receiving position and clamping elements used for horizontal feeding.

Preferably, the above-described bag transfer apparatus includes a suction plate gap adjustment mechanism that adjusts the gap between the two sets of suction plates. This suction plate gap adjustment mechanism functions so as to:

widen the gap between the two sets of suction plates when the two sets of suction plates swing, in the first swinging direction, from the downward-facing position into the sideward-facing position; and narrow the gap between the two sets of suction plates when the two sets of suction plates swing in the second swinging direction which is opposite from the first swinging direction.

This arrangement is effective in cases where the pitch P1 of the bags in the bag-making apparatus (i.e., the distance between the centers of the adjacent bags) and the installation spacing P2 of the two sets of grippers (distance between the centers of the two sets of grippers) have a relationship of P2>P1. In this arrangement, the gap between the two sets of suction plates (distance between the centers of the two sets of suction plates) can be caused to coincide with the pitch PI of the bags in the bag-making apparatus at the receiving position, and this gap can be widened and caused to coincide with the installation spacing P2 of the two sets of grippers at the transfer position.

In addition, the suction plate gap adjustment mechanism, for instance, adjusts the gap between the two sets of suction plates in response to the bag width when the two sets of suction plates are in the downward-facing position, and it also maintains the gap between the two sets of suction plates at a constant distance regardless of the bag width when the two sets of suction plates are in the sideward-facing position.

This function is to comply with differences in the bag width. In other words, in cases where the bag width P is altered, the pitch P1 of the bags is naturally altered as well; however, since the installation spacing P2 of the grippers is generally constant regardless of the bag width P, the gap when the two sets of suction plates reach the sideward-facing position must be maintained at a constant value regardless of the bag width P.

Furthermore, in the above-described W type bag-making and packaging machine, the pitch P1 of the bags is the same as the bag width P, and the installation spacing P2 of the grippers is generally set at a value that is wider than the bag width P. Accordingly, there is generally a relationship of P2>P1.

On the other hand, if P2=P1, there is no need to widen or narrow the gap between the two sets of the suction plates as the suction plates swing; and the gap can be maintained at a constant value or distance. In this case as well, with the suction plate gap adjustment mechanism being provided, the bag-making apparatus can handle the changes in the bag width Pf.

Furthermore, the above-described bag transfer apparatus, more specifically, includes two swing supporting shafts that are disposed parallel to the feeding direction of the film, two slide shaft holders that are respectively fastened to the swing supporting shafts, two slide shafts which are respectively supported on the slide shaft holders so as to be free to slide in a direction of length thereof and are respectively provided perpendicular to the swing supporting shafts, two sets of suction plates which are respectively attached to the front ends of the slide shafts, a suction plate swing mechanism that causes both of the two swing supporting shafts to make a reciprocating rotational motion and thus causes the two sets of suction plates to make a reciprocating swing motion together with both of the two slide shafts between a lower downward-facing position and an upper sideward-facing position, and a suction plate advancing and retracting mechanism which causes both of the two slide shafts to slide in a direction of length thereof and thus causes the two sets of suction plates to advance or retract; and in this structure:

both of the two swing supporting shafts have a common axis line, the two sets of suction plates are provided in the feeding direction of the film, the suction plate advancing and retracting mechanism lowers the two sets of suction plates by a specified distance toward the receiving position and then raises the suction plate when the two sets of suction plates are in the downward-facing position, and further causes the two sets of suction plates to advance by a specified distance toward the transfer position and then retracts the two sets of suction plates when the two sets of suction plates are in the sideward-facing position, and both of the two swing supporting shafts are freely adjustable positionally in the horizontal plane in the direction perpendicular to the feeding direction of the film.

In the above bag transfer apparatus, a suction plate gap adjustment mechanism, which adjusts the positions of both of the swing supporting shafts in the direction of axial line thereof by way of moving both of the swing supporting shafts in mutually opposite directions and thus adjusting the gap between the two sets of suction plates, can be provided.

This suction plate gap adjustment mechanism functions, for instance, so as to:

widens the gap between the two sets of suction plates by moving both of the swing supporting shafts in one moving direction when the two sets of suction plates swing, in one swinging direction, from the downward-facing position into the sideward-facing position; and narrows the gap between the two sets of suction plates by moving both of the swing supporting shafts in another moving direction which is opposite from the one moving direction when the two sets of suction plates swing in another swinging direction which is opposite from the one swinging direction.

In addition, the suction plate gap adjustment mechanism can be designed so that it adjusts the gap in response to the bag width when the two sets of suction plates are in the downward-facing position and maintains the gap at a constant distance regardless of the bag width when the two sets of suction plates are in the sideward-facing position.

In cases where there is no need to widen or narrow the gap between the two sets of suction plates when these suction plates swing, the suction plate gap adjustment mechanism is not activated during the rotation of the swing supporting shafts, and it is used only in cases where the bag width is altered.

The cutting apparatus used in the bag-making and packaging machine of the present invention preferably includes a film supporting plate which is disposed in a horizontal attitude in the receiving position so as to support the film and is tiltably provided so that the bag mouth side of the film is set to be lower than other portion of the film, a swing mechanism that causes the film supporting plate to swing between the horizontal attitude and a tilted attitude, upper and lower cutting blades which are provided on the upstream side of the film supporting plate and are attached to a cutter blade supporting shaft that is disposed along the direction of length of the film on the bag bottom side of the film so that the cutting blades are free to open and close upward and downward, and an opening and closing mechanism that opens and closes the upper and lower cutting blades.

With the cutting apparatus as described above, when, for instance, defective bags with defective sealing, etc. are generated, these defective bags are caused to slide naturally downward on the inclined film supporting plate and lower cutting blade and discharged below by way of opening the upper and lower cutting blades and simultaneously inclining the film supporting plate. Furthermore, in cases where defective cutting occurs in, for example, a W type apparatus on the front side of the two cutting locations (i.e., in cases where two bags are not cut and separated apart), then, by way of opening the upper and lower cutting blades and simultaneously inclining the film supporting plates, the two bags with defective cutting will naturally slide downward on the inclined film supporting plates and lower cutting blades and will be discharged below.

DETAILED DESCRIPTION OF THE INVENTION

Below, the bag-making and packaging machine of the present invention will be described concretely with reference to FIGS. 1 through 9.

Figure 1:
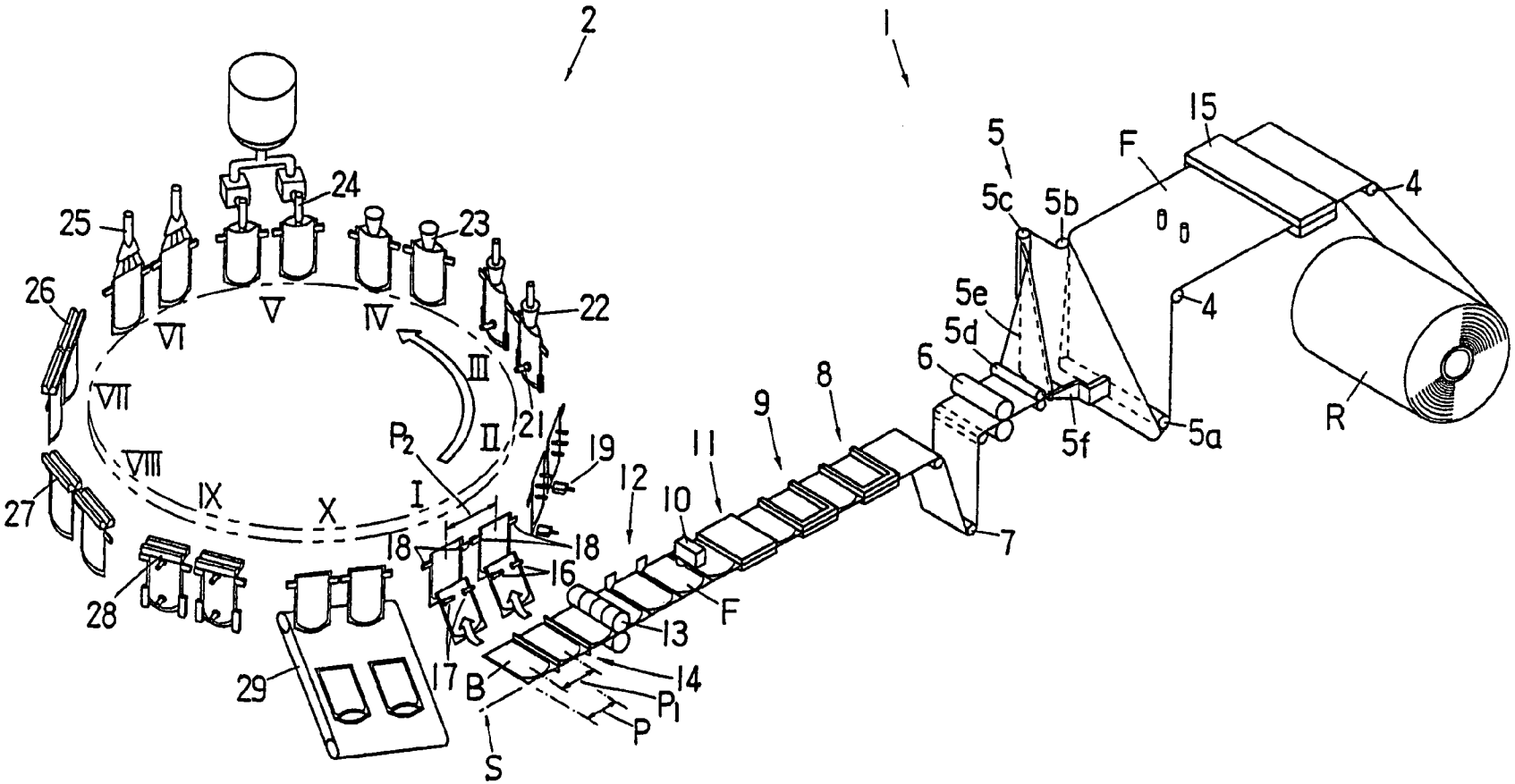
FIG. 1 is an overall schematic diagram of the bag-making and packaging machine of the present invention.

FIG. 1 is a schematic diagram of a W type bag-making and packaging machine in which a bag-making apparatus 1 and a rotary type bag-filling packaging apparatus 2 are installed. A bag transfer apparatus 3 (only the suction plates 16 and 17 thereof are shown in FIG. 1) is disposed between this bag-making apparatus 1 and rotary type bag-filling packaging apparatus 2.

The bag-making apparatus 1 continuously unwinds a film F from a film roll R whose axial center is disposed in the horizontal direction, and forms this film into self-standing bags (bags whose bottom portions are gusset folded). This bag-making apparatus includes a plurality of guide rollers 4, a forming apparatus 5 (forming rollers 5*a* through 5*d*, a forming plate 5*e* and a bag bottom folding-in plate 5*f*), feed rollers 6 (continuously rotating), a dancer roller 7, a first sealing apparatus 8 (only the sealing plates are shown in FIG. 1), a second sealing apparatus 9 (only the sealing plates are shown in FIG. 1), a cooling apparatus 11 (only the cooling plates are shown in FIG. 1), a notch forming apparatus 12 (only the notch cutter is shown in FIG. 1), feed rollers 13 (intermittently rotating), and a cutting apparatus 14 (only the cutting blades are shown in FIG. 1), etc. In FIG. 1, the reference numeral 15 indicates a film splicing apparatus.

In this bag-making apparatus 1, the film F is unrolled from the film roll R, continuously fed in the direction of length, and folded in two and overlapped in a horizontal attitude by the forming plate 5*e* of the forming apparatus 5. At the same time, a gatefold is formed in the bag bottom by a bag bottom fold-in plate 5*f*, and the film F is intermittently fed out via the dancer roller 7 (feeding pitch=twice the bag width P). In this film F, the locations corresponding to the bag bottom portion and both side portions are sealed twice by the first sealing apparatus 8 and second sealing apparatus 9. Then, the sealed locations are cooled by the cooling apparatus 11, circular arc form cut-in portions are formed in locations corresponding to both upper-end corners of the bags by the notch forming apparatus 12, and the film is finally cut into individual bags by the cutting apparatus 14, thus producing two bags B at the same time.

Ordinarily, in the film roll, the film is rolled with the side that forms the inside surfaces of the bags on the inside of the roll. In the bag-making apparatus 1, the film F is unrolled so that the side that forms the inside surfaces of the bags always faces downward. The film F is fed in the direction of length and enters the forming apparatus 5. In the forming apparatus 5 as well, the side of the film that forms the inside surfaces of the bags never faces upward, and the bag mouth side of the film F that leaves the forming apparatus 5 faces in a sideward direction. Accordingly, foreign matter such as dirt, etc. tends not to enter the interiors of the bags.

When the film roll R is replaced, and the trailing end of the film in the previous film roll is spliced with the leading end of the film in the new film roll by the film splicing apparatus 15, the side that forms the outside surfaces of the bags faces upward. Accordingly, it is easy to make a pattern alignment.

All of the apparatuses that constitute the above-described bag-making apparatus 1 are disposed with reference to a line (indicated by the arrow S) that corresponds to the bag lower ends of the film F that is folded and overlapped. In the bag-making apparatus 1, the position of the above-described line is not altered regardless of the bag length of the bags that are manufactured. Accordingly, it is possible to minimize the adjustment of the set positions of the respective apparatuses accompanying an alteration (changes) in the bag length.

The positioning of the respective apparatuses with reference to the position corresponding to the bag lower ends of the film that is folded and overlapped in the bag-making apparatus is of the type in which the film is folded and overlapped vertically, and this is described in the above-described Japanese Patent Application Laid-Open (Kokai) No. 56-113522.

Following the bag-making apparatus 1, the bag transfer apparatus 3 suction-chucks two bags B that have been separated by cutting using two sets of suction plates 16 and 17 (in the shown embodiment, two suction plates are taken as one set), lifts the bags B from a horizontal state to an upright state, and then supplies these bags B one at a time to the two sets of grippers 18 of the bag-filling packaging apparatus 2.

The bag-filling packaging apparatus 2 is itself generally known (for example, see the above-described Japanese Patent Application Laid-Open (Kokai) No. 2002-36392). In the stopping position I, the bag-filling packaging apparatus 2 receives the supply of two bags B simultaneously with its two adjacent sets of grippers 18. After both edge portions of the bags B have been gripped by these grippers 18, successive packaging operations are simultaneously performed on the two bags B that move intermittently along a circular path with the intermittent rotation of a table. More specifically, during the movement of the bags from stopping position I to stopping position II, printing is performed on the bag surfaces by a printer 19, while in stopping position III, the bag mouths and bag bottoms are opened by suction plates 21 and air nozzles 22, etc., and in stopping position IV, the bags are filled with solid matter via hoppers 23. Furthermore, in stopping position V, the bags are filled with liquid matter via nozzles 24, and in stopping position VI, steam is sprayed into the bags from steam nozzles 25 so that gas replacement is performed inside the bags. Then, in stopping position VII, the bag mouths are sealed by first sealing heaters 26, and in stopping position VIII, the bag mouths are again sealed by second sealing heaters 27. In stopping position IX, the sealed portions are cooled by sealing bars 28, and in stopping position X, the grippers 18 are opened so that the filled and sealed bags B are caused to drop onto a discharge conveyor 29.

The transfer apparatus 3 of the present invention will be described below with reference to FIGS. 2 through 5.

The transfer apparatus 3 includes swing supporting shafts 31 and 32 that are disposed parallel to the feeding direction of the film F, slide shaft holders 33 and 34 that are respectively fastened to swing supporting shafts 31 and 32, slide shafts 35 and 36 that are respectively supported in the slide shaft holders 33 and 34 so that these slide shafts 35 and 36 are free to slide in the direction of length of the slide shaft holders 33 and 34, the suction plates 16 and 17 that are attached to the front ends of the slide shafts 35 and 36, a suction plate swing mechanism 37 that causes the swing supporting shafts 31 and 32 to make a reciprocating pivot motion, thus causing the suction plates 16 and 17 to make a reciprocating swing motion together with the slide shafts 35 and 36, a suction plate advancing and retracting mechanism 38 that causes the slide shafts 35 and 36 to slide in the direction of length thereof, thus causing the suction plates 16 and 17 to advance and retract, and a suction plate gap adjustment mechanism 39 that adjusts the positions of the swing supporting shafts 31 and 32 in the axial direction thereof by causing these shafts 31 and 32 to move in opposite directions, thus adjusting the gap between the suction plates 16 and 17.

An upper plate 42 is fastened in a horizontal attitude to the upper end of a hollow stand 41 that is installed in an upright position on an apparatus base (not shown), and a main frame 43 is disposed on this upper plate 42. The bottom plate 43*a* of the main frame 43 rides on the upper plate 42, and both sides of the main frame 43 are supported by a pair of slide guides 44 and 45 that are disposed perpendicular to the direction of feeding of the film F, so that the main frame 43 is moved along the slide guides 44 and 45 when necessary.

The swing supporting shaft 32 is supported by a bearing member 46 fastened to the main frame 43 so that this swing supporting shaft 32 is free to rotate and free to slide in the axial direction, and the swing supporting shaft 31 is supported in the hollow interior of the swing supporting shaft 32 via slide bearings 48 and 49 so that this swing supporting shaft 31 is free to slide in the axial direction. The swing supporting shaft 31 is supported by a slide bearing 47 that is fastened also to the main frame 43 so that the swing supporting shaft 31 is free to slide in the axial direction. The axial lines (central axes of rotation) of the swing supporting shafts 31 and 32 are in a position to coincide.

The slide shaft 35 is supported in the slide shaft holder 33 via slide bearings 51 and 52 with the axial direction of this slide shaft 35 being perpendicular to the swing supporting shaft 31. The slide shaft 35 is constantly urged rearward (the suction plate 16 side is taken as the "forward" direction, thus the slide shaft 35 is constantly urged in the direction opposite from the suction plate 16 in FIG. 5) by a compression spring 53. Furthermore, a roller 54 is disposed on the rear end of the slide shaft 35. The slide shaft 36 is supported, in the same structure to the slide shaft 35, in the slide shaft holder 34; and a roller 55 is disposed on the rear end of this slide shaft 36.

Figure 2:
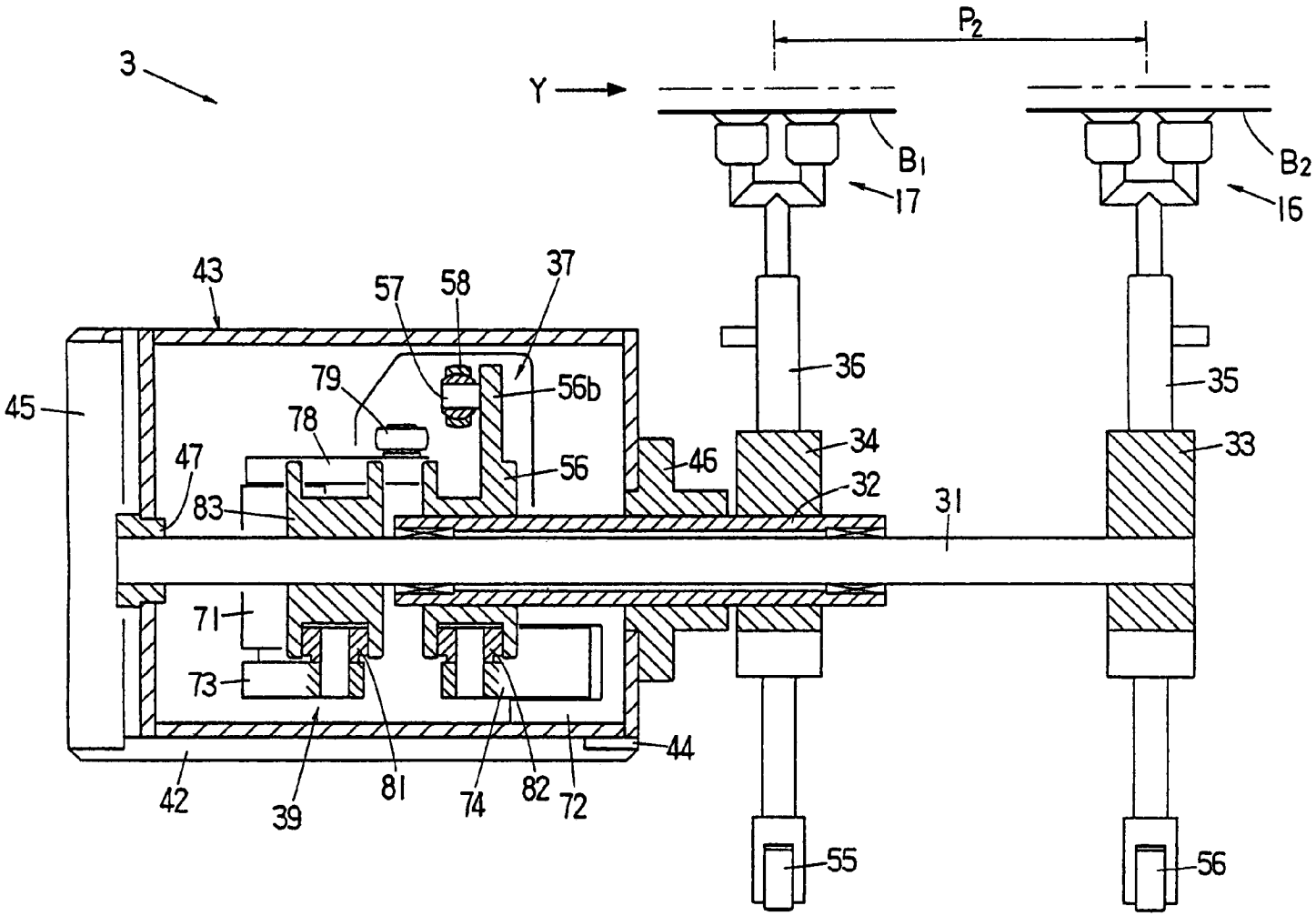
FIG. 2 is a sectional top view of the transfer apparatus used in the bag-making and packaging machine of the present invention with the suction plates being in the sideward-facing position.

FIG. 2 shows a part of the suction plate swing mechanism 37.

A grooved ring 56 is fastened to the rear end of the swing supporting shaft 32; and the upper end of a drive rod 58, which is connected to a driving source (not shown) and is raised and lowered, is attached to a connecting shaft 57 that is fastened to the lever section 56*b* of the ring 56. As a result of the rising and lowering motions of the drive rod 58, the swing supporting shafts 31 and 32 make a 90-degree reciprocating rotational motion. As a result of this rotational motion, the suction plates 16 and 17 make a reciprocating swing motion together with the slide shafts 35 and 36 between a downward-facing position (shown by the solid lines in FIG. 4) and a sideward-facing position (shown by the imaginary (two-dotted) lines in FIG. 4) which is at a higher position than the downward-facing position.

Figure 4:
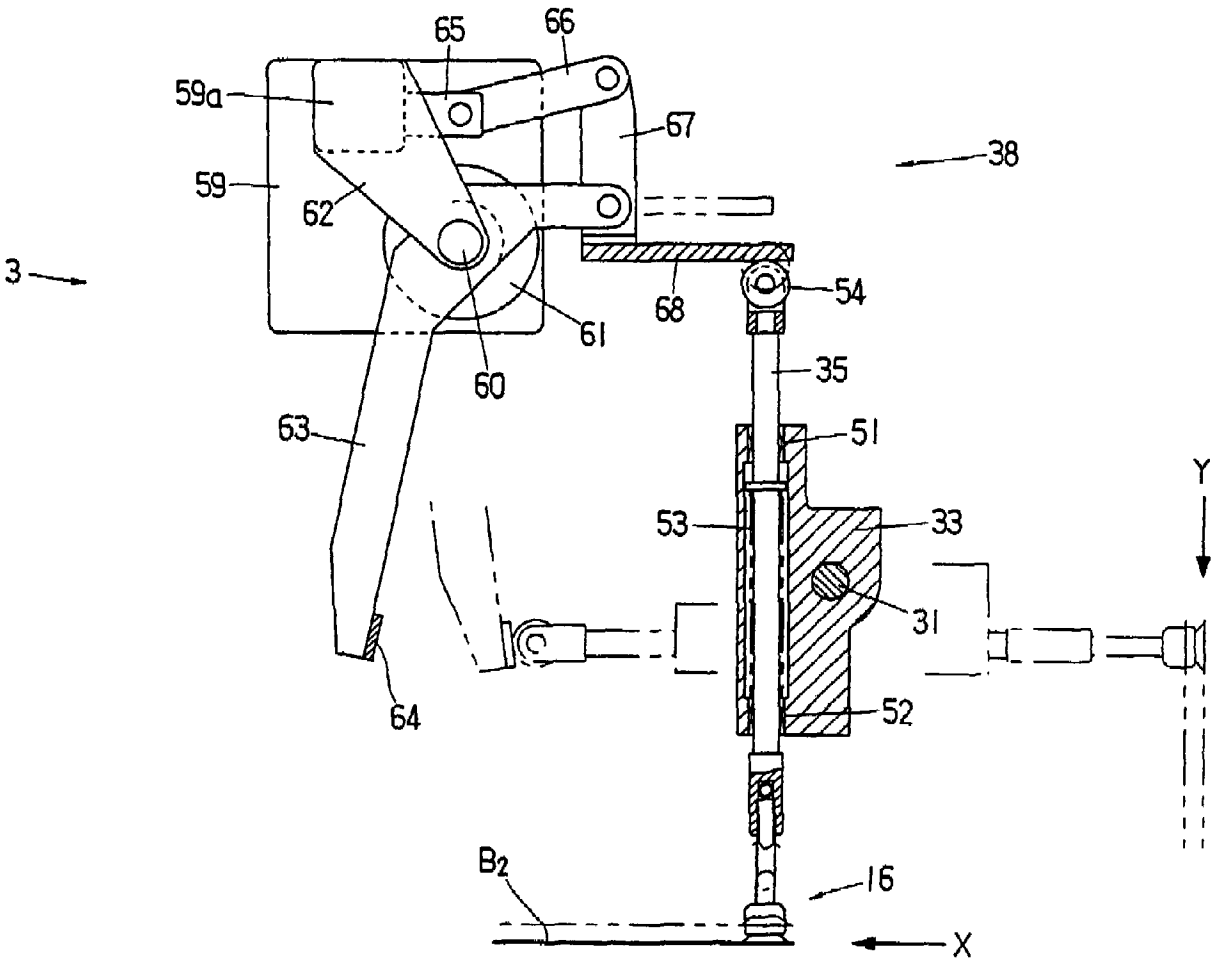
FIG. 4 is a sectional right-side view of the essential portion of the transfer apparatus.
Figure 5:
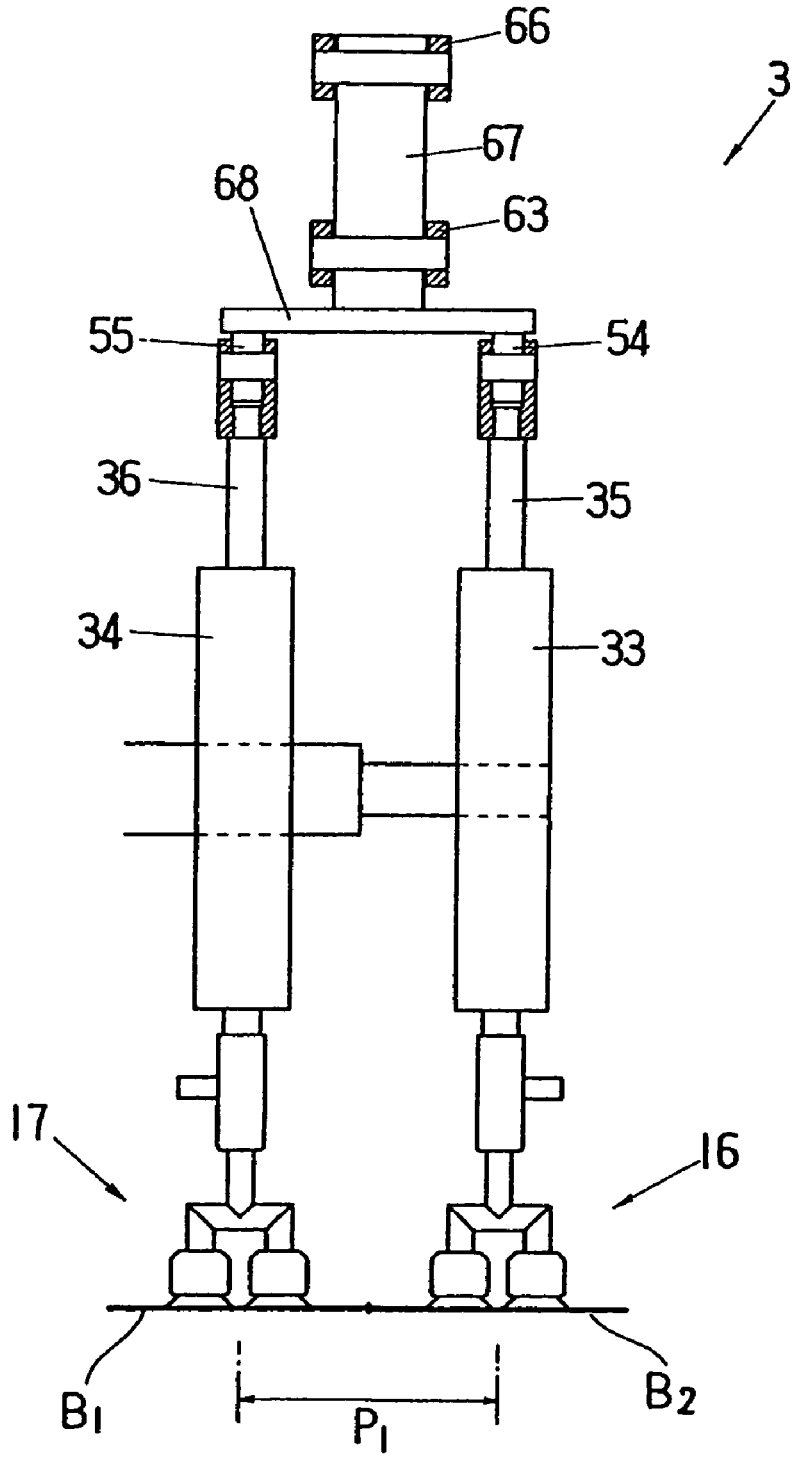
FIG. 5 is a partially sectional front view of the essential portion of the transfer apparatus.

As shown in FIG. 4, the suction plate advancing and retracting mechanism 38 is attached via legs (not shown) to a sub-frame 59 that is attached to the above-described apparatus base. A pressing lever supporting shaft 60 is rotatably supported by a bearing section 61 that is attached to the sub-frame 59 and a shaft supporting plate 62 that is fastened to the tip of a protruding portion 59*a* of the sub-frame 59. The axial direction of this pressing lever supporting shaft 60 is set to be parallel to the feeding direction of the film F. A pressing lever 63 is fastened to the pressing lever supporting shaft 60, and a pressing member 64 is fastened to the lower end of the pressing lever 63. This pressing member 64 is formed with somewhat greater width along the feeding direction of the film F. Furthermore, one end of a link 66 is pin-connected to a supporting block 65 fastened to the protruding portion 59*a* of the sub-frame 59, and the other end of this link 66 is pin-connected to the upper end of a connecting member 67. A point in the vicinity of the lower end of the connecting member 67 is pin-connected to the upper end of the pressing lever 63, and a pressing member 68 is fastened to the lower end of the connecting member 67 horizontally. The width of this pressing member 68 along the feeding direction of the film F is substantially the same as that of the pressing member 64.

When the pressing lever supporting shaft 60 that is connected to a driving source (not shown) is rotated, the pressing lever 63 swings between the position indicated by the solid line and the position indicated by the imaginary line in FIG. 4. Consequently, the pressing member 64 swings more or less horizontally in the plane perpendicular to the feeding direction of the film F. At the same time, the pressing member 68 is raised and lowered between the position indicated by the solid line and the position indicated by the imaginary line in FIG. 4 (while maintaining a horizontal attitude) by a parallel link mechanism (constructed from the pressing lever 63, link 66 and connecting member 67).

As will be described later, even if the bag length is changed, the swing ranges of the pressing members 64 and 68 shown in FIG. 4 are not altered (in other words, there is no movement of the sub-frame 59).

Figure 3:
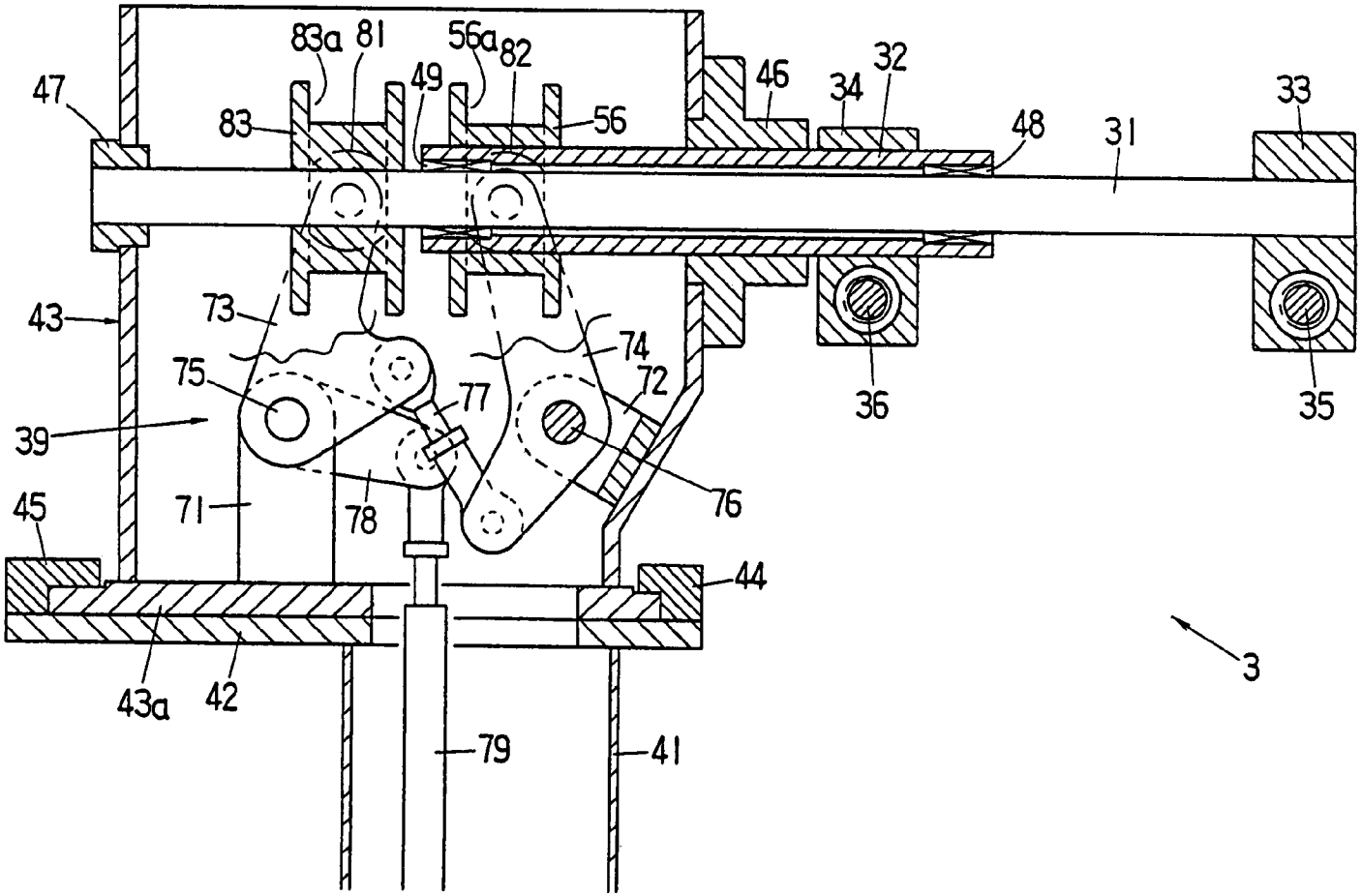
FIG. 3 is a sectional front view of the transfer apparatus with the suction plates being in the sideward-facing position.

The suction plate gap adjustment mechanism 39 is shown in FIGS. 2 and 3.

In this suction plate gap adjustment mechanism 39, supporting blocks 71 and 72 are disposed on the main frame 43, and lever supporting shafts 75 and 76 which are fastened to intermediate potions of L-shaped levers 73 and 74 are supported on the supporting blocks 71 and 72 so that these lever supporting shafts 75 and 76 are free to rotate. The L-shaped levers 73 and 74 are connected to each other by a connecting rod 77. One end of a drive lever 78 is fastened to the lever supporting shaft 75, and the other end of this drive lever 78 is connected to a drive rod 79 which is connected to a driving source (not shown) and is raised and lowered. Engaging members 81 and 82 are disposed on the upper ends of the L-shaped levers 73 and 74. The engaging member 81 can freely slide through the groove 83*a* of a grooved ring 83 that is fastened to the swing supporting shaft 31, and the engaging member 82 can freely slide through the groove 56*a* of the grooved ring 56.

When the drive rod 79 is raised or lowered, the L-shaped levers 73 and 74 respectively swing in opposite directions about the lever supporting shafts 75 and 76, so that the engaging member 81 and engaging member 82 push the grooved ring 83 and grooved ring 56 in mutually opposite directions, thus causing the swing supporting shafts 31 and 32 to move in opposite directions. Consequently, the gap between the suction plates 16 and 17 is either widened or narrowed.

Next, the cutting apparatus 14 which is a part of the bag-making apparatus 1 of the present invention will be described with reference to FIGS. 6 through 8.

The cutting apparatus 14 includes film supporting plates 85 and 86 that are disposed in a horizontal attitude and support the film F, a swing mechanism 87 that causes the film supporting plates 85 and 86 to swing between a horizontal attitude and an inclined attitude, two sets of cutter blades including first upper and lower cutting blades 88 and second upper and lower cutting blades 89 that are disposed on the upstream side of the film supporting plates 85 and 86 and cut the film F so that bags B are separated by cutting, and an opening-and-closing mechanism 91 that opens and closes the upper and lower cutting blades 88 and 89. These elements are disposed on a frame 93 that is fastened to the upper end of a stand 92 that is installed in an upright position on the upper surface of the apparatus base (not shown).

A slide rail 94 is fastened to the undersurface of the frame 93 so as to be parallel to the feeding direction of the film F, slide members 95 and 96 are fitted over this slide rail 94, and slide frames 97 and 98 are fastened to the slide members 95 and 96. Both ends of film supporting plate supporting shafts 101 and 102 that form the swing centers of the film supporting plates 85 and 86 are fastened to the slide frames 97 and 98. Both ends of cutter blade supporting shafts 103 and 104 that form the swing centers of the upper and lower cutting blades 88 and 89 are also fastened to the slide frames 97 and 98.

Arms 105 and 106 are mounted on the film supporting plate supporting shafts 101 and 102 so as to pivot, and the film supporting plates 85 and 86 are fastened to the tip ends of these arms 105 and 106. The first upper and lower cutting blades 88 (88*a* and 88*b*) and the second upper and lower cutting blades 89 (89*a* and 89*b*) are respectively mounted on the cutter blade supporting shafts 103 and 104 so as to make a pivot motion.

The driving source of the swing mechanism 87 is an air cylinder 108 whose rear end is connected to a bracket 107 on the frame 93. The tip end of the piston rod 109 of this air cylinder 108 is connected to the rear end of the arm 105. The swing mechanism 87 has a separate air cylinder that is connected to a bracket 111 on the frame 93. The film supporting plates 85 and 86 are swingable independently of each other between a horizontal attitude and an inclined attitude as a result of the operation of the two air cylinders.

Figure 6:
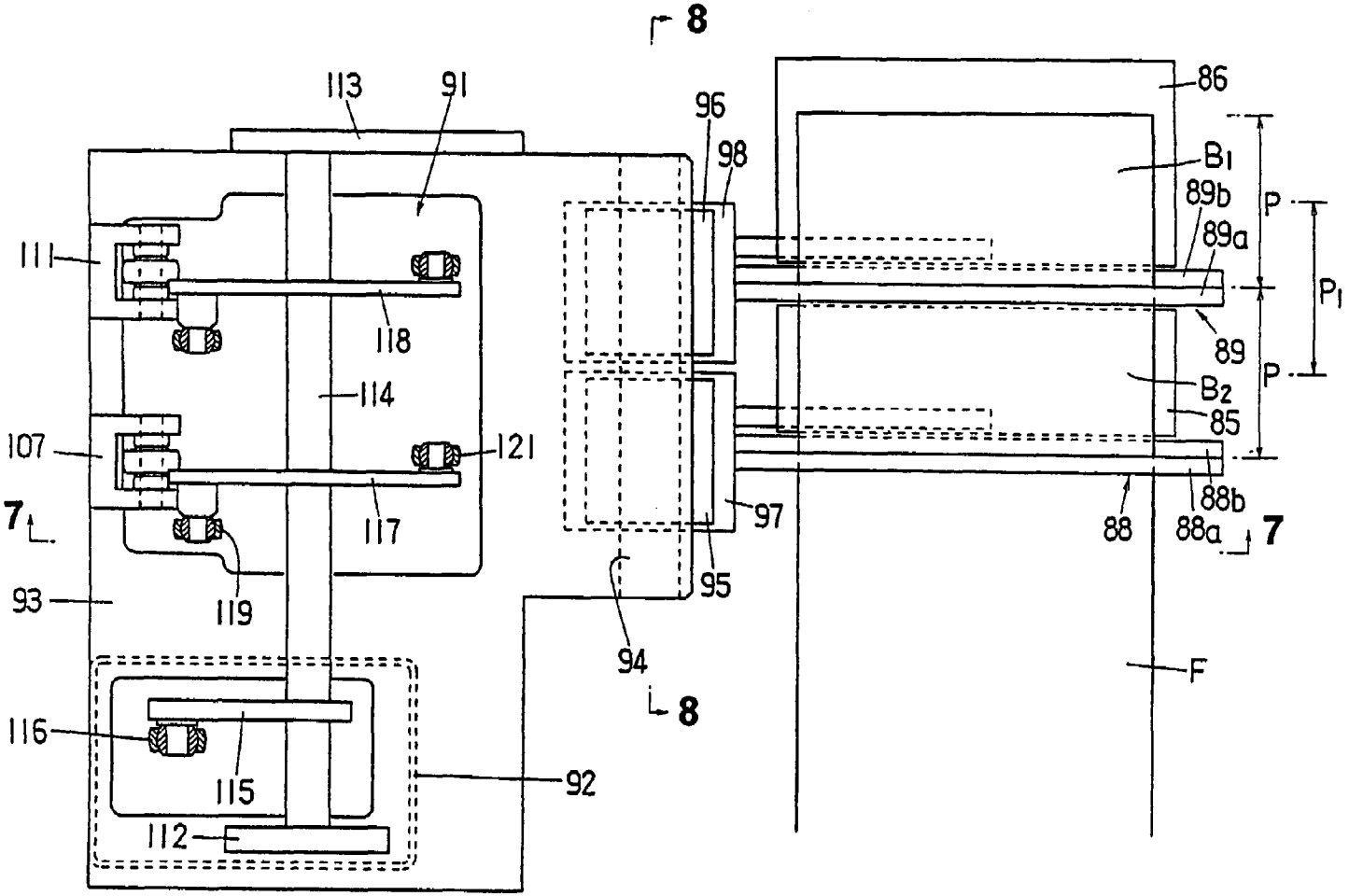
FIG. 6 is a partially sectional top view of the cutting apparatus used in the bag-making and packaging machine of the present invention.
Figure 7:
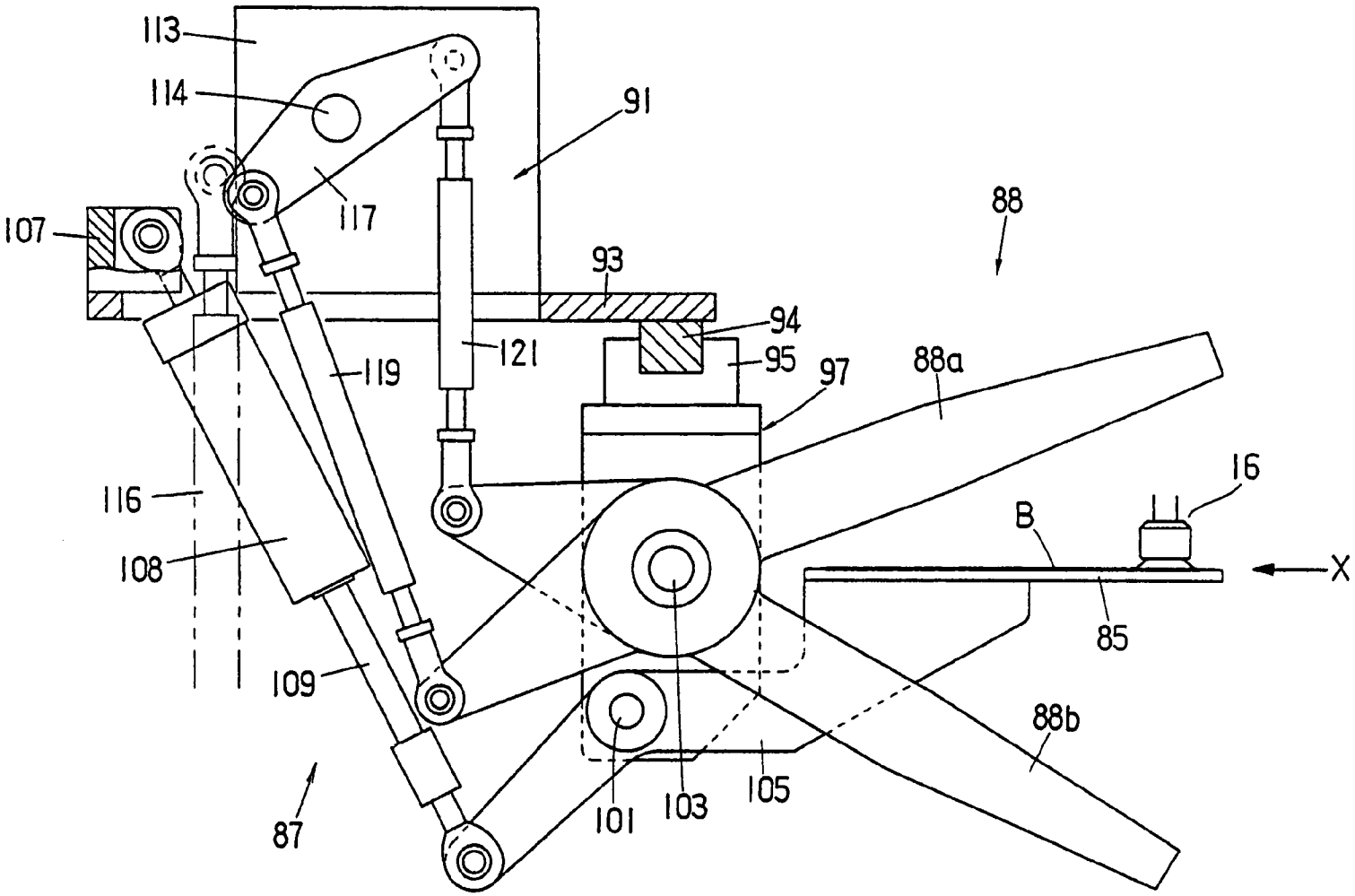
FIG. 7 is a sectional view taken along the lines 7—7 in FIG. 6.
Figure 8:
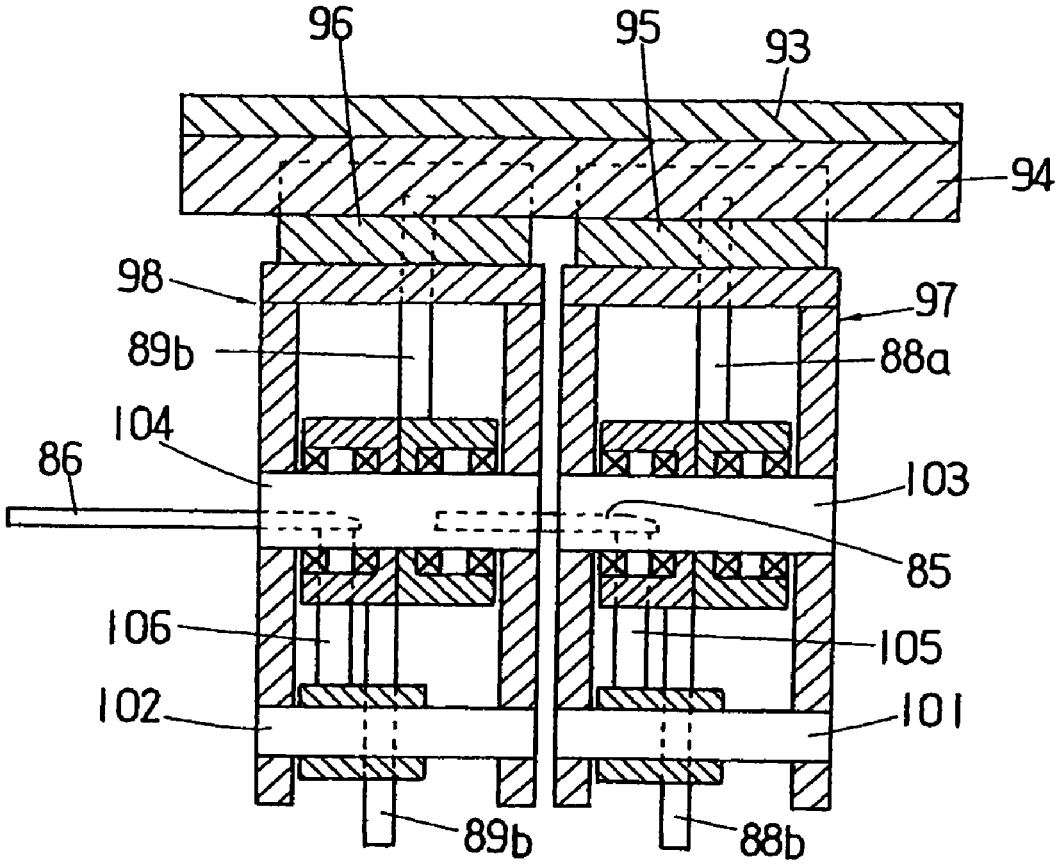
FIG. 8 is a sectional view taken along the lines 8—8 in FIG. 6.

The opening-and-closing mechanism 91 is shown in FIGS. 6 and 7.

Bearing members 112 and 113 are disposed in upright positions on the frame 93, and a pivot shaft 114 is supported by the bearing members so that this pivot shaft 114 is rotatable. A drive lever 115 is fastened to the pivot shaft 114, and the tip end of a drive rod 116 connected to a driving source (not shown) is connected to this drive lever 115. Opening-and-closing levers 117 and 118 are fastened to the pivot shaft 114, and both ends of the opening-and-closing lever 117 are connected to the rear ends of the first upper and lower cutting blades 88 (88*a* and 88*b*) via connecting rods 119 and 121. Though not shown in FIG. 7, both ends of the opening-and-closing lever 118 are also connected to the rear ends of the second upper and lower cutting blades 89 (89*a* and 89*b*) by connecting rods similar to those for the opening-and-closing lever 117.

When the drive rod 116 is raised and lowered in this opening-and-closing mechanism 91, the upper and lower cutting blades 88 and 89 are opened and closed via the drive lever 115, pivot shaft 114 and opening-and-closing levers 117 and 118, etc.

Next, the operation of the cutting apparatus 13 will be described.

As shown in FIG. 6, the leading end position and amount of feeding of the film F are set so that when the film F that has been intermittently fed into the cutting apparatus 13 in a horizontal attitude stops, the upstream side position at a distance equal to the bag width P from the leading end of the film F makes the cutting position by the second upper and lower cutting blades 89, and the upstream side position at a distance equal to twice the bag width P from this leading end makes the cutting position by the first upper and lower cutting blades 88. As a result of this setting, the pitch PI of the bags B (distance between the centers of adjacent bags B) coincides with the bag width P.

When the drive rod 116 is raised in this case, the upper and lower cutting blades 88 and 89 simultaneously close, thus cutting the film F from the horizontal direction so that two bags B (hereafter, in cases where it is necessary to distinguish the two bags that are separated by cutting at the same time, the leading bag will be labeled as $B_1$, and the following bag will be labeled as $B_2$) are separated by cutting from the film F. Then, the drive rod 116 is lowered, so that the upper and lower cutting blades 88 and 89 simultaneously open. Since the cutting in this case cuts into the film from the bag bottom side of the bags B, even if the bags B are self-standing bags (in which the bag bottoms are overlapped four times and sealed so that the bag bottoms are thickened), cutting can easily be accomplished.

The leading bag $B_1$ that is separated by cutting is on the film supporting plate 86, the following bag $B_2$ is on the film supporting plate 85, and these bags are suction-chucked by the suction plates 16 and 17 of the transfer apparatus 3 (the suction plate 16 chucks the bag $B_2$, and the suction plate 17 chucks the bag $B_1$). Accordingly, the upper surfaces of the film supporting plates 85 and 86 are referred to as the receiving position X of the bags.

In cases where sealing defects, etc. are detected by the photoelectric sensor 10 (see FIG. 1), the air cylinder 108 is actuated by the detection signal, and the film supporting plates 85 and 86 are inclined. Since the upper and lower cutting blades 88 and 89 are also opened in this case, the two bags slide downward over the inclined film supporting plates 85 and 86 and the lower cutting blades 88*b* and 89*b* that are inclined in the same direction, and these bags are discharged below.

The same is true in cases where separation by cutting is no accomplished in the second upper and lower cutting blades 89. Furthermore, in cases where separation by cutting is not accomplished in the first upper and lower cutting blades 88, the leading bag $B_1$ is likewise discharged, and the next bag $B_2$ hangs downward from the tip of the film supporting plate 86 as a result of the next feeding of the film F, so that the bag does not become entangled in the lower cutting blades 88*b* and 89*b*. This bag $B_2$ is discharged together with the following bag that is separated by the next cutting operation.

In cases where the bag width P is changed in the bag-making apparatus 1, the locking of the slide member 95 with respect to the slide rail 94 is released, and the slide frame 97 is caused to slide along the slide rail 94, thus making an adjustment so that the first upper and lower cutting blades 88 are located in a position that corresponds to a new bag width. At the same time, if necessary, the film supporting plate 85 is replaced by a film supporting plate that has a width that corresponds to the width of a new bag and is then locked again. There is no need to adjust the position of the second upper and lower cutting blades 89. Accordingly, there is no need to release the locking of the slide member 96 on the side of the slide frame 98.

As to the width of the film supporting plate 86, it is desirable to use a plate that has a width suitable for a maximum predicted bag width.

Next, the transfer operation of the transfer apparatus 3 will be described below.

The suction plates 16 and 17 receive two bags B in the receiving position X and transfer these bags to the two adjacent sets of grippers 18 of the bag-filling packaging apparatus 2. The position of these grippers 18 is the transfer position Y.

As described above, the pitch of the bags B in the receiving position X is P1, and this pitch is equal to the bag width P. On the other hand, since the grippers 18 are of the type in which they grip both side edges of the bags B from the sides, the installation spacing P2 of the grippers 18 is greater than the bag width P, so that P2>P1. Accordingly, the gap between the suction plates 16 and 17, which is P1 at the receiving position X, must increase to the size of P2 at the transfer position Y.

The transfer operation of the transfer apparatus 3 is performed as follows:

(1) When the swing supporting shafts 31 and 32 are caused to rotate by the suction plate swing mechanism 37 so that the suction plates 16 and 17 come to the downward facing position (see FIGS. 4 and 5), the drive rod 79 of the suction plate gap adjustment mechanism 39 is lowered to a specified position, so that the gap between the suction plates 16 and 17 is narrowed to the size of P1.

(2) As a result of the rotation of the pressing lever supporting shaft 60 of the suction plate advancing and retracting mechanism 38, the pressing member 68 presses the rollers 54 and 55 of the slide members 35 and 36. Consequently, the suction plates 16 and 17 are lowered to the receiving position X, and they suction-chuck the bags $B_1$ and $B_2$ on the film supporting plates 85 and 86 (as shown by the imaginary line (before being suction-chucked)→solid line (after being chucked) in FIG. 4). Then, the pressing lever supporting shaft 60 begins to rotate in reverse, so that the pressing member 68 is raised, and the suction plates 16 and 17 are raised and returned to their original positions while chucking the bags $B_1$ and $B_2$.

(3) The swing supporting shafts 31 and 32 turn in reverse so that the suction plates 16 and 17 begin to swing toward the side-ward facing position, and at the same time, the drive rod 79 of the suction plate gap adjustment mechanism 39 begins to rise. As a result, the swing supporting shafts 31 and 32 are moved so that the gap between the suction plates 16 and 17 widens.

(4) When the suction plates 16 and 17 reach the sideward-facing position, the bags $B_1$ and $B_2$ are lifted into a vertical attitude (as shown by the imaginary line in FIG. 4 which shows only the suction plate 16). In this case, furthermore, the drive rod 79 reaches the rising end, so that the gap between the suction plates 16 and 17 becomes the size of P2 as shown in FIG. 2. In other words, the rising end of the drive rod 79 is set so that the gap between the suction plates 16 and 17 is the size of P2. Meanwhile, as a result of the rotation of the pressing lever supporting shaft 60, the pressing member 64 advances to the vicinity of the rollers 54 and 55.

(5) As a result of the rotation of the pressing lever supporting shaft 60, the pressing member 64 advances further and pushes the rollers 54 and 55 forward (to the right in FIG. 4), so that the suction plates 16 and 17 advance to the transfer position Y (solid line (before advancing)→imaginary line (after advancing) in FIG. 2). In this transfer position Y, the bags $B_1$ and $B_2$ are transferred to the two sets of grippers 18. Then, the pressing lever supporting shaft 60 begins to rotate in reverse, the pressing member 64 is retracted, and the suction plates 16 and 17 are retracted and returned to their original positions.

(6) As a result of the reverse operation of the suction plate swing mechanism 37 and suction plate gap adjustment mechanism 39, the suction plates 16 and 17 come to the downward-facing position, and the gap between these suction plates is the size of P1.

(7) The above process is repeated.

The above-described bag-making and packaging machine can easily handle the changes in the bag size (bag length and/or bag width). In cases where the bags B are changed to bags with a different bag length, the following adjustments are made:

(1) In the bag-making apparatus 1, since the respective apparatuses that perform bag-making operations are adjusted with reference to the position (shown by the arrow S) corresponding to the bag lower ends of the film F that has been folded and overlapped, and since this position is not altered according to the bag length, most of the apparatuses including the first and second sealing apparatuses 8 and 9 require no adjustment. The only apparatus requiring adjustment is the notch forming apparatus 12.

(2) In the transfer apparatus 3, the main frame 43 is moved along the slide guides 44 and 45 by an amount more or less corresponding to the amount of changes (alterations) in the bag length. As a result, the positions of the swing supporting shafts 31 and 32 are moved the same distance in the horizontal plane in a direction (i.e., the direction of length of the bags) perpendicular to the feeding direction of the film F, so that the suction plates 16 and 17 are adjusted to a position that allows suction-chucking of the correct position on the bags following the size change (alteration) (a position immediately beneath the upper ends of the bags regardless of the bag length). Furthermore, even if the bag length is altered, there is no change in the position of the suction plate advancing and retracting mechanism 38; accordingly the transfer position Y does not change (the distance advanced by the suction plates 16 and 17 when these suction plates arrive in the sideward-facing position changes by an amount corresponding to the amount of movement of the swing supporting shafts 31 and 32).

Furthermore, since there is no change in the height direction of the swing supporting shafts 31 and 32, the height of the suction plates 16 and 17 in the transfer position Y does not change.

(3) There is no need to adjust the bag-filling packaging apparatus 2.

In cases where the bags B are changed to bags (new bags) with a different bag width, the following adjustments are performed:

(1) In the bag-making apparatus 1, the cutting apparatus 14 is adjusted as described above. More specifically, the locking of the slide member 95 with respect to the slide rail 94 is released, and the slide frame 97 is caused to slide along the slide rail 94, thus making an adjustment so that the first upper and lower cutting blades 88 are located in a position that corresponds to the width of a new bag(s); and then the slide member 95 is locked again. If necessary, the film supporting plate 85 is replaced by a film supporting plate that has a width that corresponds to a new bag width. For the apparatuses other than the cutting apparatus 14, adjustments similar to those performed in a conventional bag-making apparatus are performed.

(2) The adjustment of the bag-filling packaging apparatus 2 is the same as that in a conventional apparatus.

(3) In the transfer apparatus 3, the raising and lowering range of the drive rod 79 of the suction disk gap adjustment mechanism 39 is adjusted. In concrete terms, the lowering end position is changed in accordance with the bag width, and the rising end position is not changed. As a result, the gap (having the size of P1) between the suction plates 16 and 17 when the suction plates 16 and 17 are in the downward-facing position is changed to a gap that corresponds to the bag width, while the gap (having the size of P2) between the suction plates 16 and 17 in the sideward-facing position is not changed. The reason for this is that the pitch P1 of the bags B is changed by the changes in the bag width, but the spacing P2 between the two adjacent sets of grippers 18 of the bag-filling packaging apparatus 2 is not changed.

In the above-described bag-making and packaging machine, the drive rod 79 of the suction plate gap adjustment mechanism 39 is raised and lowered when the suction plates 16 and 17 are caused to swing between the downward-facing position and the sideward-facing position. However, if the pitch P1 of the bags and the spacing P2 of the two sets of grippers are the same, then there is no need to raise and lower the drive rod 79; and thus, in this case, the suction plate gap adjustment mechanism 39 is operated only when the bag width is changed.

Figure 9:
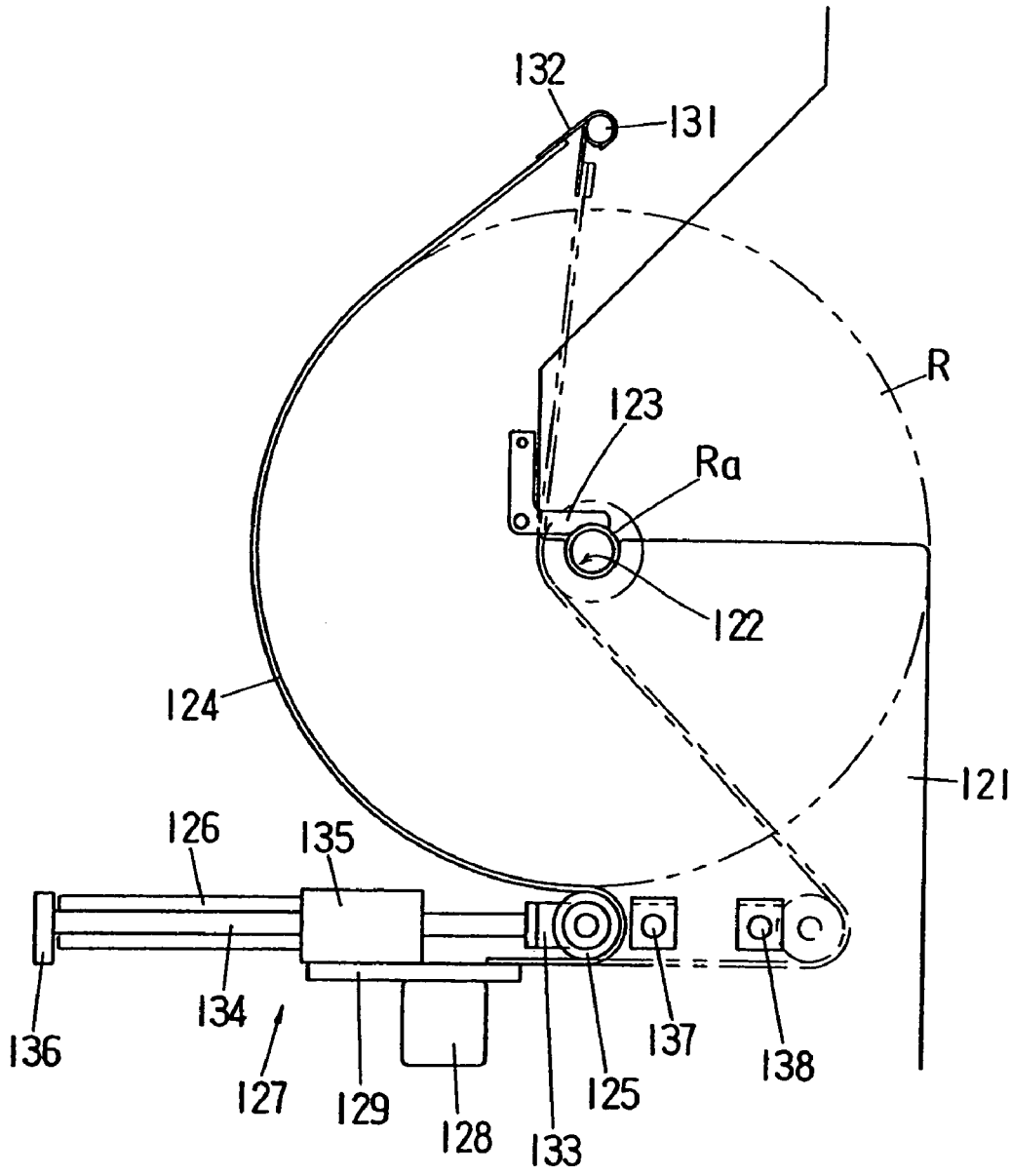
FIG. 9 is a front view of the braking device.

FIG. 9 shows a braking device that applies a braking force to the film roll R so that the film is unrolled at a constant speed.

A recess 122 is formed in a frame 121 disposed on the apparatus base (not shown), and the shaft Ra of the film roll R is set in the recess 122 so that the shaft Ra can rotate. A pressing lever 123 is detachably disposed above the shaft Ra. The lever 123 presses against the shaft Ra, so that the film roll R does not slip out of the recess 122 when the film roll R is unrolled (or released) and the diameter of the film roll R is reduced.

This braking device has a belt 124 that makes sliding contact with the surface of the film roll R, a roller 125 that applies tension to the belt, an air cylinder 126 that drives the roller 125 forward (to the right in FIG. 9), and a guide device 127 that guides the horizontal movement of the roller 125.

A bridge 128 protrudes from the side surface of the frame 121, and the lower end of the belt 124 is attached to a plate 129 that is fastened to this bridge 128. The upper end of the belt 124 is attached via an engaging fitting 132 to an engaging shaft 131 disposed above the side surface of the frame 121. The roller 125 is provided on a bracket 133 so as to be rotated, and the bracket 133 is attached to the tip end of the piston rod of the air cylinder 126.

The guide device 127 includes a guide shaft 134, and a guide shaft holder 135 which is fastened to the plate 129 and supports the guide shaft 134 slidably. The tip end of the guide shaft 134 is fastened to the bracket 133. The roller 125 advances and retracts in the horizontal plane while being guided by this guide device 127. The reference numeral 136 is a stopper that is fastened to the rear end of the guide shaft 134, and 137 and 138 indicate proximity sensors.

The belt 124 is pressed by the roller 125 so that the belt 124 is in contact with the surface of the film roll R. When the diameter of the film roll R is large, both the contact angle and contact length of the belt 124 with the film roll R are large as shown by the solid line in FIG. 9, so that a sufficient braking force can be applied to the film roll R even if the driving force of the air cylinder 126 is small. However, when the diameter of the film roll R decreases, it is necessary to increase the driving force of the air cylinder 126 so as to cause the roller 125 to protrude (so that the braking force is increased), as shown by the imaginary line in FIG. 9, in order to increase the contact angle and contact length of the belt 124 with the film roll R. For example, when the roller 125 is detected by the proximity sensor 137, the driving force of the air cylinder 126 is increased (i.e., the air pressure is increased); and when the roller 125 is detected by the proximity sensor 138, the driving force is further increased.

As seen from the above, in the present invention, the entry of foreign matter such as dirt, etc. into the interiors of the bags can be prevented by using a horizontal type bag-making apparatus in which a film is folded in two and overlapped in a horizontal attitude and bag-making operations following this folding and overlapping are performed on the film while this film is fed in a horizontal attitude. Furthermore, problems such as the entanglement of defective bags that are to be discharged with the cutting blades, and stopping of the bag-making apparatus as a result, are prevented.

Furthermore, changes in the bag size (bag length and/or bag width) can easily be handled; and even in cases where a W type apparatus is used in order to improve the productivity, changes in the bag size (bag length and/or bag width) can likewise easily be handled.

What is claimed is:

1. A bag-making and packaging machine comprising:

a bag-making apparatus for manufacturing bags by performing a bag-making operation while unwrapping a film from a film roll whose axial center is disposed in a horizontal attitude and feeding said film in a direction of length thereof, said bag-making operation including:

folding said film in two and overlapping said film by a forming apparatus, sealing said film at locations that correspond to bag bottom portions and side portions by a sealing apparatus, and separating bags by cutting with a cutting apparatus;

a bag-filling packaging apparatus which grips both side edges of said bags by means of grippers thus suspending said bags, intermittently moves said suspended bags along an annular path, and performs packaging operations including filling of said bags with contents and sealing of mouths of said bags, at respective stopping positions; and a bag transfer apparatus which receives said bags at a receiving position at a final end of said bag-making apparatus, conveys said bags to a transfer position, and transfers said bags to said grippers of said bag-filling packaging apparatus; wherein said bag-making apparatus is a horizontal type bag-making apparatus in which said film folding in two and overlapping said film is performed in a horizontal attitude by said forming apparatus, and bag-making operations are performed on said film while being fed in said horizontal attitude, positions corresponding to lower ends of folded and overlapped film bags are set in same positions regardless of a bag length, and said forming and sealing apparatuses of said bag-making apparatus are disposed with reference to said positions; and said bag fluster apparatus receives bags in a horizontal attitude, stands said bags upright and transfers said bags to said grippers of said bag-filling packaging apparatus.

2. The bag-making and packaging apparatus according to claim 1, wherein said bag transfer apparatus comprises:

a suction plate is freely, swingably disposed in a vertical plane perpendicular to a feeding direction of said film, and a suction plate swing mechanism for causing said suction plate to swing in a reciprocating motion between a lower downward-facing position and an upper sideward-facing position; wherein said suction plate suction-chucks bag surfaces of said bags in a horizontal attitude when said suction plate is in said lower downward-facing position, and stands said bags upright when said suction plate is in said upward sideward-facing position, and a position of an axial line of a swing motion of said suction plate is freely adjustable within a horizontal plane in a direction perpendicular to said feeding direction of said film.

3. The bag-making and packing machine according to claim 2, wherein said bag transfer apparatus comprises a suction plate advancing and retracting mechanism for:

lowering said suction plate by a specified distance toward said receiving position and then raising said suction plate when said suction plate is in said lower downward-facing position, and advancing said suction plate by a specified distance toward said transfer position and then retracting said suction plate when said suction plate is in said upward sideward-facing position.

4. The bag-making and packaging machine according to claim 1, wherein said bag transfer apparatus comprises:

a swing supporting shaft that is disposed parallel to said feeding direction of said film, a slide shaft holder that is fastened to said swing supporting shaft, a slide shaft which is supported on said slide shaft holder so as to be free to slide in a direction of length thereof and is provided perpendicular to said swing supporting shaft, a suction plate which is attached to a front end of said slide shaft, a suction plate swing mechanism that causes said swing supporting shaft to make a reciprocating rotational motion for causing said suction plate to make a reciprocating swing motion together with said slide shaft between a lower downward-facing position and an upper sideward-facing position, and a suction plate advancing and retracting mechanism for causing said slide shaft to slide in a direction of a length thereof to cause said suction plate to advance or retract; and wherein said suction plate advancing and retracting mechanism lowers said suction plate by a specified distance toward said receiving position and then raises said suction plate when said suction plate is in said lower downward-facing position, and further causes said suction plate to advance by a specified distance toward said transfer position and then retracts said suction plate when said suction plate is in said sideward-facing position, and said swing supporting shaft is freely adjustably positionable in a horizontal plane in a direction perpendicular to said feeding direction of said film.

5. The bag-making and packaging machine according to claim 1, wherein said bag-making apparatus is a W type bag-making apparatus which manufactures two bags at a time by causing an amount of a film that is intermittently fed from said sealing apparatus to be twice a bag width and performing respective bag-making operations at a same time on said film that is twice a bag width, said bag-filling packaging apparatus is a W type bag-filling packaging apparatus in which bags are simultaneously supplied to two adjacent sets of said grippers, and packaging operations are simultaneously performed on said two bags gripped by said two sets of grippers, and said bag transfer apparatus is a W type bag transfer apparatus which receives two bags at said receiving position, conveys said bags to said transfer position, and transfers said bags to said two sets of grippers of said bag-filling packaging apparatus.

6. The bag-making and packaging machine according to claim 5, wherein said bag transfer apparatus comprises:

two sets of suction plates freely, swingably disposed in a vertical plane that is perpendicular to a feeding direction of said film and which are disposed along said film feeding direction, and a suction plate swing mechanism which causes said two sets of suction plates to simultaneously make a reciprocating swing motion between a lower downward-facing position and an upper sideward-facing position; and wherein bag surfaces of bags in a horizontal attitude are suction-chucked when said two sets of suction plates are respectively in said lower downward-facing position, said bags are caused to stand upright when said two sets of suction plates reach said upward sideward-facing position, axial lines of a swing motion of said two sets of suction plates are in common, and positions of said axial lines are freely adjustable in a horizontal plane in a direction perpendicular to said feeding direction of said film.

7. The bag-making and packaging machine according to claim 6, wherein said bag transfer apparatus comprises a suction plate advancing and retracting mechanism that:

simultaneously lowers, when said two sets of suction plates are in said lower downward-facing position, said two sets of suction plates by a specified distance toward said receiving position and then raises said two sets of suction plates, and simultaneously causes, when said two sets of suction plates are in said upward sideward-facing position, said two sets of suction plates to advance by a specified distance toward said transfer position and then retracts said two sets of suction plates.

8. The bag-making and packaging machine according to claim 6 or 7, wherein said bag transfer apparatus comprises a suction plate gap adjustment mechanism which adjusts a gap between said two sets of suction plates.

9. The bag-making and packaging machine according to claim 8, wherein said suction plate gap adjustment mechanism:

widens said gap between said two sets of suction plates when said two sets of suction plates swing, in a one swinging direction, from said lower downward-facing position into said upward sideward-facing position, and narrows said gap between said two sets of suction plates when said two sets of suction plates swing in another swinging direction which is opposite from said one swinging direction.

10. The bag-making and packaging machine according to claim 9, wherein said suction plate gap adjustment mechanism:

adjusts said gap between said two sets of suction plates in response to said bag width when said two sets of suction plates are in said lower downward-facing position, and maintains said gap between said two sets of suction plates at a constant distance regardless of said bag width when said two sets of suction plates are in said upward sideward-facing position.

11. The bag-making and packaging machine according to claim 10, wherein said cutting apparatus comprises:

two film supporting plates disposed in a horizontal attitude in said receiving position to support said film and are tiltably provided so that said bag mouth side of said film is set to be lower than another portion of said film, a swing mechanism that causes both of said two film supporting plates to swing between said horizontal attitude and a tilted attitude, two sets of upper and lower cutting blades which are provided on a upstream side of said film supporting plates and are respectively attached to two cutter blade supporting shafts that are disposed along a direction of length of said film on said bag bottom side of said film so that said cutting blades are free to open and close upward and downward, and an opening and closing mechanism that opens and closes said two sets of upper and lower cutting blades.

12. The bag-making and packaging machine according to claim 9, wherein said cutting apparatus comprises:

two film supporting plates disposed in a horizontal attitude in said receiving position so as to support said film and are tiltably provided so that said bag mouth side of said film is set to be lower than another portion of said film, a swing mechanism that causes both of said two film supporting plates to swing between said horizontal attitude and a tilted attitude, two sets of upper and lower cutting blades which are provided on a upstream side of said film supporting plates and are respectively attached to two cutter blade supporting shafts that are disposed along a direction of length of said film on said bag bottom side of said film so that said cutting blades are free to open and close upward and downward, and an opening and closing mechanism that opens and closes said two sets of upper and lower cutting blades.

13. The bag-making and packaging machine according to claim 8, wherein said cutting apparatus comprises:

two film supporting plates disposed ia a horizontal attitude in said receiving position to support said film and are tiltably provided so that said bag mouth side of said film is set to be lower than another portion of said film, a swing mechanism that causes both of said two film supporting plates to swing between said horizontal attitude and a tilted attitude, two sets of upper and lower cutting blades which are provided on an upstream side of said film supporting plates and are respectively attached to two cutter blade supporting shafts that are disposed along a direction of length of said film on said bag bottom side of said film so that said cutting blades are free to open and close upward and downward, and an opening and closing mechanism that opens and closes said two sets of upper and lower cutting blades.

14. The bag-making and packaging machine according to any one of claims 5 through 7, wherein said cutting apparatus comprises:

two film supporting plates which are disposed in a horizontal attitude in said receiving position so as to support said film and are tiltably provided so that said bag mouth side of said film is set to be lower than another portion of said film, a swing mechanism that causes both of said two film supporting plates to swing between said horizontal attitude and a tilted attitude, two sets of upper and lower cutting blades which are provided on a upstream side of said film supporting plates and are respectively attached to two cutter blade supporting shafts that are disposed along a direction of length of said film on said bag bottom side of said film so that said cutting blades are free open and close upward and downward, and an opening and closing mechanism that opens and closes said two sets of upper and lower cutting blades.

15. The bag-making and packaging machine according to claim 1, wherein said bag transfer apparatus comprises:

two swing supporting shafts disposed parallel to said feeding direction of said film, two slide shaft holders respectively fastened to said swing supporting shafts, two slide shafts respectively supported on said slide shaft holders so as to be free to slide in a direction of length thereof and are respectively provided perpendicular to said swing supporting shafts, two sets of suction plates which are respectively attached to front ends of said two slide shafts, a suction plate swing mechanism that causes both of said two swing supporting shafts to make a reciprocating rotational motion to cause said two sets of suction plates to make a reciprocating swing motion together with both of said two slide shafts between a lower downward-facing position and an upper sideward-facing position, and a suction plate advancing and retracting mechanism which causes both of said two slide shafts to slide in a direction of length thereof to cause said two sets of suction plates to advance or retract; and wherein both of said two swing supporting shafts have a common axis line, said two sets of suction plates are provided in said feeding direction of said film, said suction plate advancing and retracting mechanism lowers said two sets of suction plates by a specified distance toward said receiving position and then raises said two sets of suction plates when said two sets of suction plates are in said lower downward-facing position, and further causes said two sets of suction plates to advance by a specified distance toward said transfer position and then retracts said two sets of suction plates when said two sets of suction plates are in said upward sideward-facing position, and both of said two swing supporting shafts are freely adjustably positionable horizontal plane in a direction perpendicular to said feeding direction of said film.

16. The bag-making and packaging machine according to claim 15, wherein said bag transfer apparatus comprises a suction plate gap adjustment mechanism which adjusts positions of both of said two swing supporting shafts in a direction of an axial line thereof by moving both of said two swing supporting shafts in mutually opposite directions and thus adjusting a gap between said two sets of suction plates.

17. The bag-making and packaging machine according to claim 16, wherein said suction plate gap adjustment mechanism:

widens said gap between said two sets of suction plates by moving both of said two swing supporting shafts in one moving direction when said two sets of suction plates swingin a one swinging direction from a lower downward-facing position into an upper sideward-facing position, and narrows said gap between said two sets of suction plates by moving both of said two swing supporting shafts in another moving direction which is opposite from said one moving direction when said two sets of suction plates swing in said another swinging direction which is opposite from said one swinging direction.

18. The bag-making and packaging machine according to claim 17, wherein said suction plate gap adjustment mechanism:

adjusts said gap between said two sets of suction plates in response to said bag width when said two sets of suction plates are in said lower downward-facing position, and maintains said gap between said two sets of suction plates at a constant distance regardless of a bag width when said two sets of suction on plates are in said upward sideward-facing position.

19. The bag-making and packaging machine according to any one of claims 15 through 18, wherein said cutting apparatus comprises:

two film supporting plates disposed in a horizontal attitude in said receiving position to support said film and are tiltably provided so that said bag mouth side of said film is set to be lower than another portion of said film, a swing mechanism that causes both of said two film supporting plates to swing between said horizontal attitude and a tilted attitude, two sets of upper and lower cutting blades which are provided on a upstream side of said film supporting plates and are respectively attached to two cutter blade supporting shafts that are disposed along a direction of length of said film on said bag bottom side of said film so that said cutting blades are free to open and close upward and downward, and an opening and closing mechanism that opens and closes said two sets of upper and lower cutting blades.

20. The bag-making and packaging machine according to any one of claims 1 through 4, wherein said cutting apparatus comprises:

a film supporting plate which is disposed in a horizontal attitude in said receiving position to support said film and is tiltably provided so that said bag mouth side of said film is set to be lower than another portion of said film, a swing mechanism that causes said film supporting plate to swing between said horizontal attitude and a tilted attitude, upper and lower cutting blades which are provided on a upstream side of said film supporting plate and are respectively attached to a cutter blade supporting shaft that is disposed along a direction of length of said film on said bag bottom side of said film so that said cutting blades are free to open and close upward and downward, and an opening and closing mechanism that opens and closes said upper and lower cutting blades.

* * * * *